US010570921B2

(12) United States Patent
Geffert

(10) Patent No.: US 10,570,921 B2
(45) Date of Patent: Feb. 25, 2020

(54) PUMP HAVING A PLURALITY OF ADJUSTABLE OUTLET OPENINGS

(71) Applicant: Dr. Ing. h.c. F. Porsche Aktiengesellschaft, Stuttgart (DE)

(72) Inventor: Thomas Geffert, Freiberg am Neckar (DE)

(73) Assignee: Dr. Ing. h.c. F. Porsche Aktiengesellschaft (DE)

( * ) Notice: Subject to any disclaimer, the term of this patent is extended or adjusted under 35 U.S.C. 154(b) by 262 days.

(21) Appl. No.: 15/569,138

(22) PCT Filed: Feb. 11, 2016

(86) PCT No.: PCT/EP2016/025009
§ 371 (c)(1),
(2) Date: Oct. 25, 2017

(87) PCT Pub. No.: WO2016/173722
PCT Pub. Date: Nov. 3, 2016

(65) Prior Publication Data

US 2018/0149171 A1 May 31, 2018

(30) Foreign Application Priority Data

Apr. 29, 2015 (DE) ..... 10 2015 106 639

(51) Int. Cl.
*F04D 29/42* (2006.01)
*F01P 5/12* (2006.01)
(Continued)

(52) U.S. Cl.
CPC ..... *F04D 29/4293* (2013.01); *F01P 5/10* (2013.01); *F01P 5/12* (2013.01); *F04D 13/06* (2013.01);
(Continued)

(58) Field of Classification Search
CPC .. F04D 27/002; F04D 27/003; F04D 27/0246; F04D 27/0253; F04D 29/46;
(Continued)

(56) References Cited

U.S. PATENT DOCUMENTS 1,220,403 A * 3/1917 Doble ..... F04D 29/462 415/148
3,698,832 A * 10/1972 Price ..... F04D 15/0022 415/148
(Continued)

FOREIGN PATENT DOCUMENTS

DE 195 45 561 8/1997
DE 10 2007 007 670 8/2008
(Continued)

OTHER PUBLICATIONS

International Search Report dated Apr. 25, 2016.

*Primary Examiner* — Nathaniel E Wiehe
*Assistant Examiner* — Andrew J Marien
(74) *Attorney, Agent, or Firm* — Gerald E. Hespos; Michael J. Porco; Matthew T. Hespos

(57) ABSTRACT

A pump (1, 101) includes a pump housing (2, 102) having an intake opening (5, 105) and a plurality of outlet openings (6, 106). A pump wheel (9, 109) is accommodated in the housing (2, 102) in a rotationally drivable manner to effect a fluid stream from the intake opening (5, 105) to the respective outlet opening (6, 106). An adjustable ring element (13, 113) is provided radially outside the pump wheel (9, 109) and inside the housing (2, 102). The adjustable ring element (13, 113) enables the fluid stream through the respective outlet opening (6, 106) to be regulated.

12 Claims, 7 Drawing Sheets

(51) Int. Cl.

| | |
|---|---|
| ***F04D 15/00*** | (2006.01) |
| ***F01P 5/10*** | (2006.01) |
| ***F04D 29/62*** | (2006.01) |
| ***F04D 13/06*** | (2006.01) |
| ***F04D 29/08*** | (2006.01) |
| *F01P 7/14* | (2006.01) |

(52) U.S. Cl.
CPC ..... *F04D 15/0022* (2013.01); *F04D 29/086* (2013.01); *F04D 29/426* (2013.01); *F04D 29/628* (2013.01); *F01P 2007/146* (2013.01); *F05D 2250/52* (2013.01)

(58) Field of Classification Search
CPC .... F04D 29/462; F04D 29/464; F04D 29/466; F04D 29/468; F04D 9/4293; F04D 15/0022; F04D 29/628; F05D 2250/52; F01P 5/10; F01P 2007/146
See application file for complete search history.

(56) References Cited

U.S. PATENT DOCUMENTS 3,784,318 A * 1/1974 Davis ..... F04D 15/0038 415/158
4,084,926 A * 4/1978 Gram ..... F04C 2/101 418/19
5,366,347 A * 11/1994 Hoglund ..... F04C 19/00 415/169.1
5,617,815 A * 4/1997 Spies ..... F16K 11/076 123/41.1
5,785,013 A 7/1998 Sinn et al.
9,243,649 B2 * 1/2016 Fournier ..... F04D 15/0027
9,945,283 B2 * 4/2018 Muizelaar ..... F01P 7/14
2008/0271689 A1 * 11/2008 Konias ..... F01L 1/34 123/90.17
2009/0301412 A1 * 12/2009 Genster ..... F04D 29/466 123/41.44
2010/0078049 A1 * 4/2010 Assmann ..... A47L 15/4289 134/184
2012/0076640 A1 * 3/2012 Popp ..... F04D 15/0038 415/151
2014/0286747 A1 * 9/2014 Fang ..... F04D 29/4293 415/1
2015/0027572 A1 * 1/2015 Morein ..... F16K 11/0876 137/625.19
2015/0027575 A1 * 1/2015 Morein ..... F16K 11/165 137/865
2018/0320694 A1 * 11/2018 Zielberg ..... F04D 15/0038

FOREIGN PATENT DOCUMENTS

DE 10 2011 090 208 7/2013
WO 2009/070565 6/2009

* cited by examiner

PUMP HAVING A PLURALITY OF ADJUSTABLE OUTLET OPENINGS

BACKGROUND

Field of the Invention

The invention relates to a pump, such as in particular a water pump for a motor vehicle.

Description of the Related Art

Water pumps, in particular as coolant pumps in motor vehicles, are widely known. For example, DE 195 45 561 A1 discloses such a water pump as a radial pump, which draws in water in an axial direction via an intake opening and, via a pump wheel, radially outwardly conveys and radially on the outside discharges said water. CH 133 892 discloses such a pump which has radially outside the pump wheel an annular slide which is displaceable in an axial direction and regulates the throughflow. The annular slide may also be rotated in a circumferential direction, wherein openings of the annular slide are settable so as to overlap or to not overlap mouths of connecting channels. Consequently, throughflow limitation can likewise be realized. The annular slide is in this case formed to be hydraulically displaceable in an axial direction or in a circumferential direction.

The fluid flow at the outlet of the pump is set by means of the slide. However, this does not result in a specific division of the fluid flow.

It is the object of the present invention to create a pump that is of simple construction and that nevertheless permits good setting or regulation of different fluid flows.

SUMMARY

An exemplary embodiment of the invention relates to a pump having a pump housing with an intake opening and with a plurality of outlet openings, having a pump wheel which is accommodated in a rotationally drivable manner in the housing in order to bring about in each case a fluid flow from the intake opening to the respective outlet opening, wherein there is provided radially outside the pump wheel and inside the housing an adjustable annular element by means of which the fluid flow through the respective outlet opening is settable. A pump is thereby created and is able to produce multiple settable or regulable fluid flows. The respective fluid flow can be set, for example, by adjustment of the annular element by way of an actuator. The pump is nevertheless of compact design and is simple to assemble.

In an advantageous exemplary embodiment, it is expedient if the housing is of substantially cylindrical form and has a first end wall and a second end wall and a radially outer circumferential wall. The outlet openings are arranged on the radially outer circumferential wall. Consequently, the outlet openings may be arranged to be distributed around the circumference, with the result that the outflow is realized via these outlet openings arranged in a distributed manner. In this case, the control of the fluid flows depends on the arrangement of the outlet openings and on the design of the annular element.

The outlet openings may be arranged on the radially outer circumferential wall so as to be distributed in the circumferential direction and spaced apart from one another. This allows the fluid flows through the respective outlet opening to be influenced by the position and/or the formation of the outlet openings.

The intake opening may be arranged on a first of the two end walls. This allows a favorable design to be provided, because the inward fluid flow on the intake side can occur in an axial direction, while the outlet flow on the pressure side can occur in a radial direction.

For the purpose of driving the pump wheel, a drive shaft may engage through an opening in the second end wall. This allows the pump wheel to be driven by an external drive, such as for example via a belt pulley of a belt drive.

A drive means for driving the pump wheel may be arranged inside the housing. The drive means may be an electric motor or the like.

The adjustable annular element may have plural fluid channels that extend from radially inside to radially outside in a spiral-shaped manner and each fluid channel opening out into one of a plural openings that are arranged radially on the outside on the annular element. This allows the total fluid flow produced to be subdivided into individual partial fluid flows such that the respective fluid flow leading to the respective outlet opening is guided through the respective spiral-shaped fluid channel from the pump wheel radially outwardly to the outlet opening. The respective fluid channels are of spiral-shaped form to be able to guide the fluid flow to the outlet opening without a large pressure loss.

At least one sealing element may be arranged radially between the adjustable annular element and the radially outer circumferential wall of the housing in the region of the respective outlet opening. Consequently, the fluid flow through the outlet opening can be limited and leakage flows can be prevented. The sealing element also serves for interrupting the fluid flow through the respective outlet opening if the annular element is set such that the outlet opening is to be closed. Then, too, no leakage flow should be present.

The sealing element may be formed to have an arcuately curved wall into which an opening is introduced. A radially outwardly projecting, encircling wall section projects from the wall at the opening. This allows the annular element to abut against the sealing element radially on the outside and to be sealed off as a result.

The wall section may project into an outlet opening. This advantageously also allows the wall section to be held fixedly in its position by the engagement into the opening.

The at least one outlet opening may be surrounded by a connecting piece that projects from the radially outer circumferential wall of the housing. Consequently, a connecting hose or tube is able to be connected, and the sealing element at the same time can be fixed securely.

The adjustable annular element may be adjustable in the circumferential direction by means of an actuator. This allows the respective fluid flow through the respective outlet opening to be set. In this case, it is advantageous if the annular element is rotatable through a defined angle of rotation, such as being rotatable back and forth to be able to assume a defined position between and including the two end positions.

The actuator may be a pneumatic, hydraulic, magnetic and/or electromotive actuator. This corresponding actuator is able to bring about a rotational movement that is transferable to the annular element. The actuator is also able to generate a translatory movement that is transferable into a rotational movement of the annular element. It is thus also advantageous if the setting of the annular element is fixable by means of the actuator, so that the assumed position does not inadvertently change during operation.

It is also advantageous if arranged axially between the pump wheel and the adjustable annular element on the one side, and an end wall of the housing on the other side, is a sealing element. The sealing element seals off the interior toward the intake opening such that no leakage flows form in this direction.

The sealing element may have a substantially annular disk with an opening, from which an axially projecting connecting piece projects all around the opening and engages into the intake opening. This allows advantageous sealing to be performed at the intake opening or at a connecting piece surrounding said opening.

Below, the invention will be discussed in detail on the basis of an exemplary embodiment and with reference to the drawing.

DETAILED DESCRIPTION

Figure 1:
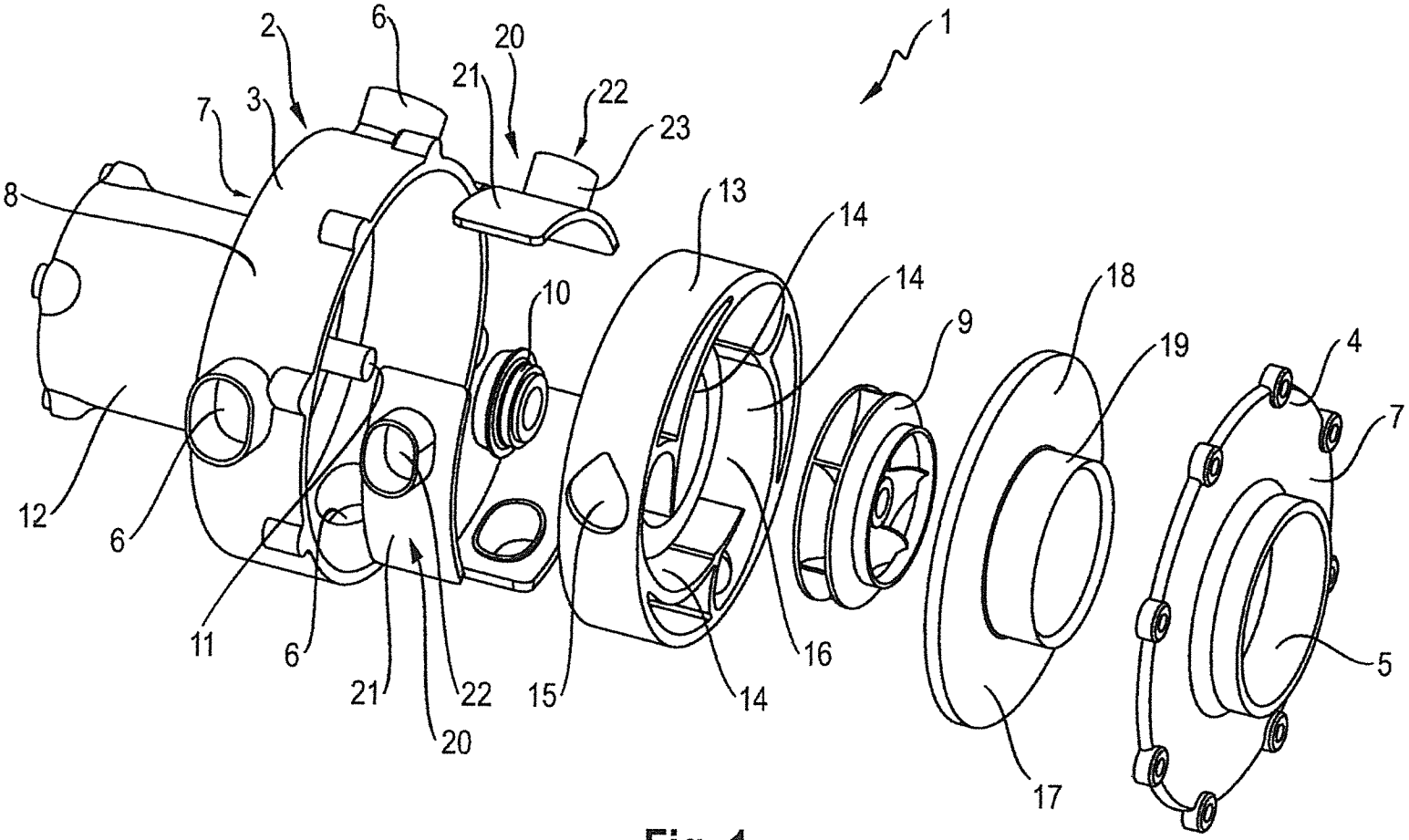
FIG. 1 shows an exploded illustration of an exemplary embodiment of a pump according to the invention.

FIG. 1 shows an exemplary embodiment of a pump 1 according to the invention in an exploded illustration.

The pump has a pump housing 2 with a first housing part 3 as a housing pot and a second housing part 4 as a housing cover. The second housing part 4 is able to be mounted onto the first housing part 3 such that it can be closed off and sealed off and defines a pump chamber.

The pump housing 2 has an intake opening 5 for drawing in a fluid. The pump housing 2 also has at least one outlet opening for discharging the pumped fluid. The pump housing 2 is of substantially cylindrical form and has two end walls 7 and a circumferential wall 8. The outlet openings 6 are in this case arranged in the circumferential wall 8 and spaced apart from one another. The intake opening 5 is arranged on the one end wall 7.

A pump wheel 9 is provided in the pump housing 2 and is formed so as to be rotationally drivable. In this case, a drive 12, which may be for example an electric motor or a belt pulley drive of a belt drive, is provided. Other drives are also usable. The rotation of the pump wheel 9 results in a fluid flow from the intake opening 5 to the at least one outlet opening 6 being produced.

The pump wheel 9 of this embodiment is arranged on a shaft 11 by means of a sliding ring 10, with the result that the pump wheel 9 rotates when the shaft 11 rotates, and the pump wheel 9 rotatably mounts on the other elements of the pump, such as for example on the housing 2.

The drive 12 for driving the pump wheel may be an electric motor with a drive shaft 11 that projects into the housing 2 and drives the pump wheel 9. As an alternative, it is also possible for a drive means, by means of which the pump wheel 9 is drivable, to be arranged inside the housing.

An adjustable annular element 13 is provided radially outside the pump wheel 9, and inside the housing 2. The adjustable annular element 13 enables the fluid flow through the respective outlet opening 6 to be set.

The adjustable annular element 13 has fluid channels 14 that extend from radially inside to radially outside in a spiral-shaped manner and that open out radially on the outside into one of plural openings 15 that are arranged radially on the outside on the annular element 13. The fluid channels 14 are in this case open radially on the inside and are in communication with the pump wheel 9 to be able to receive the fluid flow in the pump wheel 9. The radially inner region of the annular element 13 is situated radially outside the pump wheel 9, and the annular element 13 accommodates the pump wheel 9 in a central recess 16.

A sealing element 17 is arranged axially between the annular element 13 and the pump wheel 9 on the one side, and the cover 4 of the housing on the other side. The sealing element 17 is provided as a cover of the annular element 13 that serves as a spiral regulator. The sealing element has a radially extending region 18 and an axial connecting piece 19. The radially extending region 18 at least partially covers the annular element 13 laterally, and the connecting piece 19 engages into the intake opening 5.

At least one sealing element 20 is arranged radially between the adjustable annular element 13 and the radially outer circumferential wall, or annular wall 8, of the housing 2, in particular in the region of the respective outlet opening 6. It is also possible for multiple such sealing elements 20 to be arranged.

The sealing element 20 or the sealing elements 20 are formed to have an arcuately curved wall 21 into which an opening 22 is introduced, wherein, at the opening 22, a radially outwardly projecting, encircling wall section 23 projects from the wall 21 as a type of connecting piece. The encircling wall section 23 is formed as a connecting piece and engages into the outlet opening 6 of the housing 2.

If the annular element 13 rotates in the housing, fluid communication can be achieved by overlapping of at least one of the openings 15 with one of the outlet openings 6, and the result is a fluid flow on the outlet side.

As FIG. 1 shows, the outlet openings 6 are arranged on the radially outer circumferential wall, or annular wall 8, of the housing so as to be distributed in the circumferential direction and spaced apart from one another. By suitably selecting the positioning of the openings 15 and the shape thereof, targeted control of the outlet can be achieved by rotation of the annular element.

Figure 2:
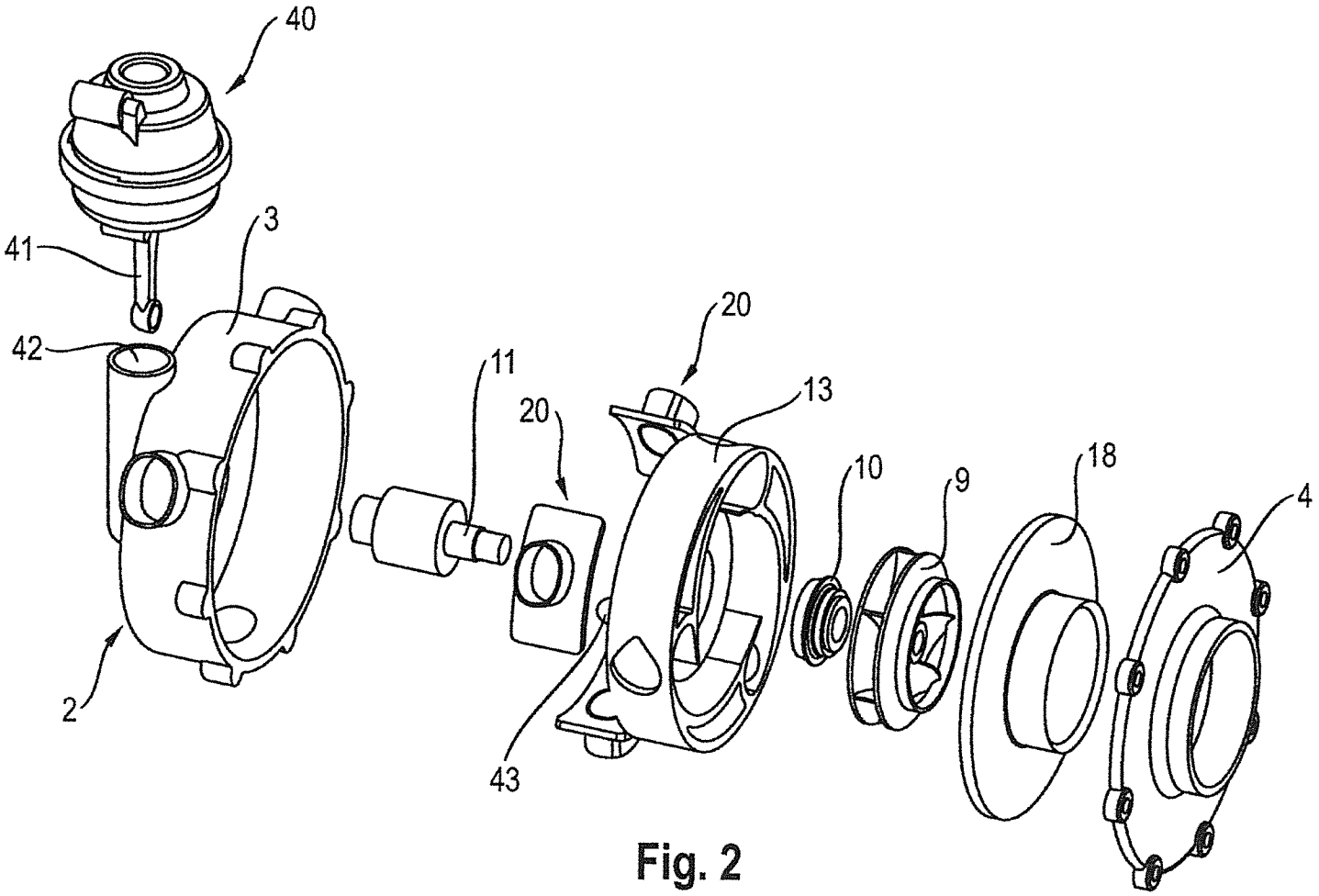
FIG. 2 shows an exploded illustration of a further exemplary embodiment of a pump according to the invention.

FIG. 2 shows a comparable configuration of a pump according to FIG. 1, wherein, in FIG. 2, an actuator 40, for example in the form of a vacuum capsule, is provided to be able to adjust the annular element 13. For this purpose, the actuator 40 has a coupling rod 41 that engages in a guide 42 of the housing 2 and that is connected to an arm 43 of the annular element 13. The annular element 13 is rotated by way of longitudinal displacement of the coupling rod 41.

Figure 3:
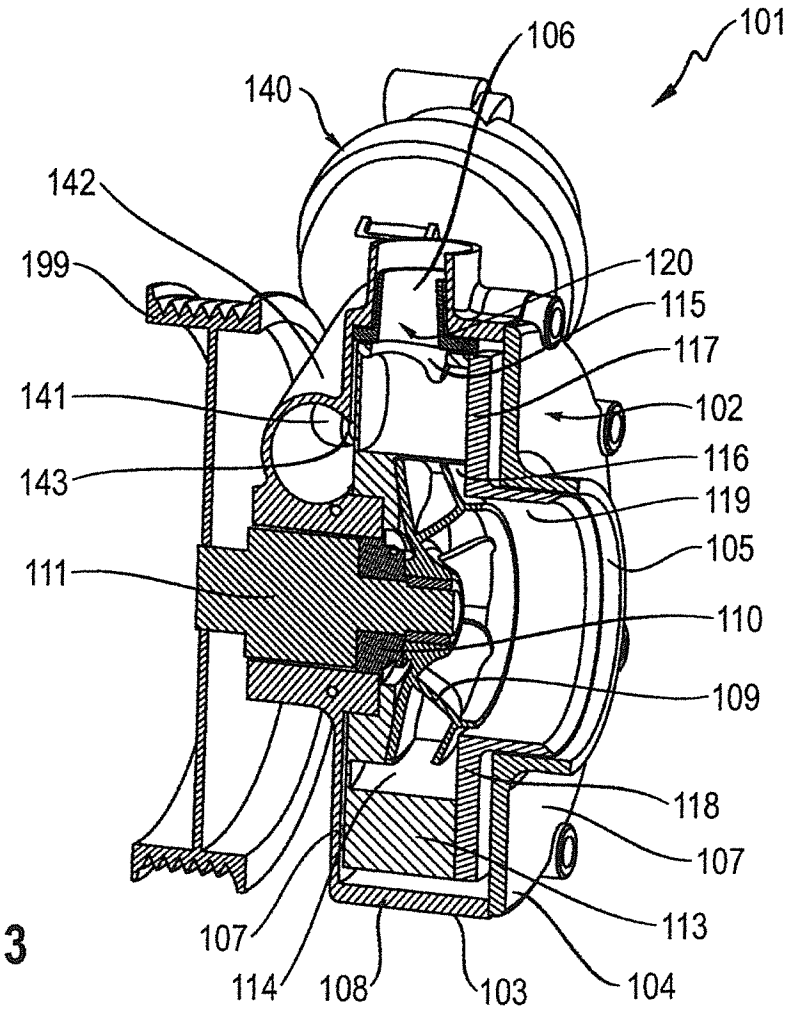
FIG. 3 shows a sectional illustration of an exemplary embodiment of a pump according to the invention.

FIG. 3 shows a sectional illustration of a pump 101 having a housing 102. The pump housing 102 has a first housing part 103 as a housing pot and a second housing part 104 as a housing cover. The second housing part 104 is mounted onto the first housing part 103 such that the housing is closed off and sealed off and defines a pump chamber.

The pump housing 102 has an axially oriented intake opening 105 for drawing in a fluid. The pump housing 102 also has at least one outlet opening 106 which leads radially outwardly and which serves for discharging the pumped fluid. The pump housing 102 is substantially cylindrical and has two end walls 107 and a circumferential wall 108. The at least one outlet opening 106 is arranged in the circumferential wall 108. In the case of more than one outlet opening 106, these are advantageously arranged spaced apart from one another in the circumferential direction. The intake opening 105 is arranged on the one end wall 107.

The pump wheel 109, which is formed so as to be rotationally drivable, is provided in the pump housing 102. In this case, a drive, which is illustrated for example as a belt pulley drive 199 of a belt drive, is provided. Other drives are also usable, such as for example an electric motor.

The rotation of the pump wheel 109 results in a fluid flow from the intake opening 105 to the at least one outlet opening 106 being produced. The pump wheel 109 is in this case arranged on a shaft 111 by means of a sliding ring 110, with the result that the pump wheel 109 rotates when the shaft 111 rotates, and the pump wheel 109 rotatably mounts on the other elements of the pump, such as for example on the housing 102.

An adjustable annular element 113 is provided inside the housing 102 and outside the pump wheel 109 for setting the fluid flow through the respective outlet opening 106.

The adjustable annular element 113 has fluid channels 114 that extend from radially inside to radially outside in a spiral-shaped manner and that each open out radially on the outside into one of plural openings 115 arranged radially on the outside on the annular element 113. The fluid channels 114 are in this case open radially on the inside and are in communication with the pump wheel 109 to be able to receive the fluid flow in the pump wheel 109. The radially inner region of the annular element 113 is situated radially outside the pump wheel 109, and the annular element 113 accommodates the pump wheel 109 in a central recess 116.

Arranged axially between the annular element 113 and the pump wheel 109 on the one side, and the housing cover 104 of the housing 102 on the other side, is a sealing element 117 that is provided as a cover of the annular element 113, which serves as a spiral regulator. The sealing element 117 has a radially extending region 118 and an axial connecting piece 119. The radially extending region 118 at least partially covers the annular element 113 laterally, and the connecting piece 119 engages into the intake opening 105.

At least one sealing element 120 is arranged radially between the adjustable annular element 113 and the radially outer circumferential wall, or annular wall 108, of the housing 2, in particular in the region of the respective outlet opening 106. It is also possible for multiple such sealing elements 120 to be arranged. The sealing element 120 is designed according to the statements relating to FIGS. 1 and 2.

If the annular element 113 rotates in the housing, fluid communication can be achieved by overlapping of at least one of the openings 115 with one of the outlet openings 106, and the result is a fluid flow on the outlet side. By suitably selecting the positioning of the openings 115 and the shape thereof, targeted control of the outlet can be achieved by rotation of the annular element 113.

For adjusting the annular element 113, an actuator 140, for example a vacuum capsule, is provided to adjust the annular element 113. For this purpose, the actuator 140 has a coupling rod 141 that engages in a guide 142 of the housing 102 and which is connected to an arm 143 of the annular element 113. The annular element 113 is rotated by way of longitudinal displacement of the coupling rod 141.

Figure 5:
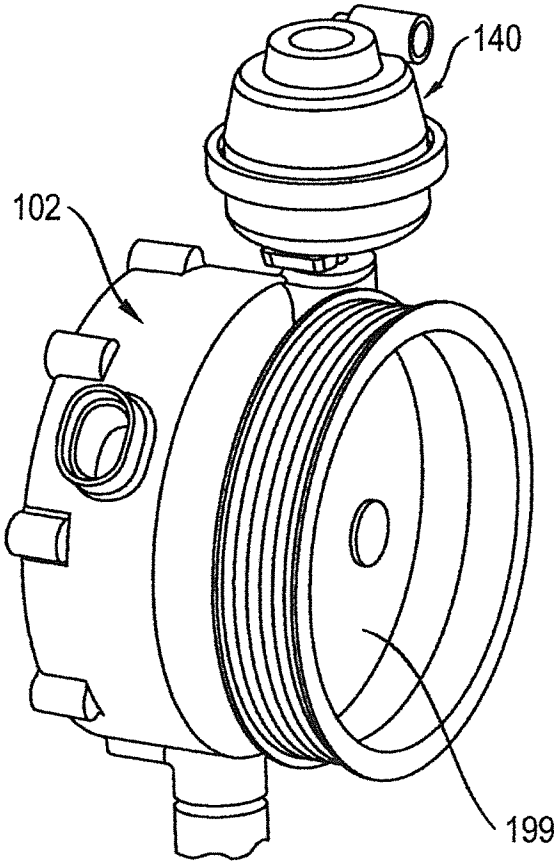
FIG. 5 shows a further side view of an exemplary embodiment of a pump according to the invention.
Figure 4:
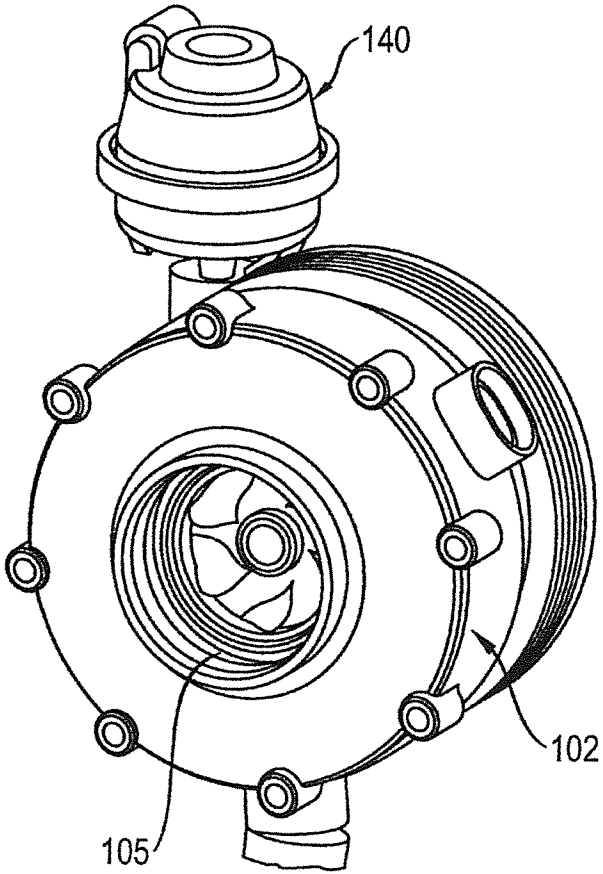
FIG. 4 shows a side view of an exemplary embodiment of a pump according to the invention.

FIGS. 4 and 5 show the pump in FIG. 3 in a respective perspective illustration from the front and from the rear. The housing 102, with the intake opening 105, and the actuator 140 can be seen in FIG. 4.

The housing 102, with the actuator 140 and with an outlet opening 106, and the belt pulley 199 for driving the pump wheel are shown in FIG. 5.

Figure 6:
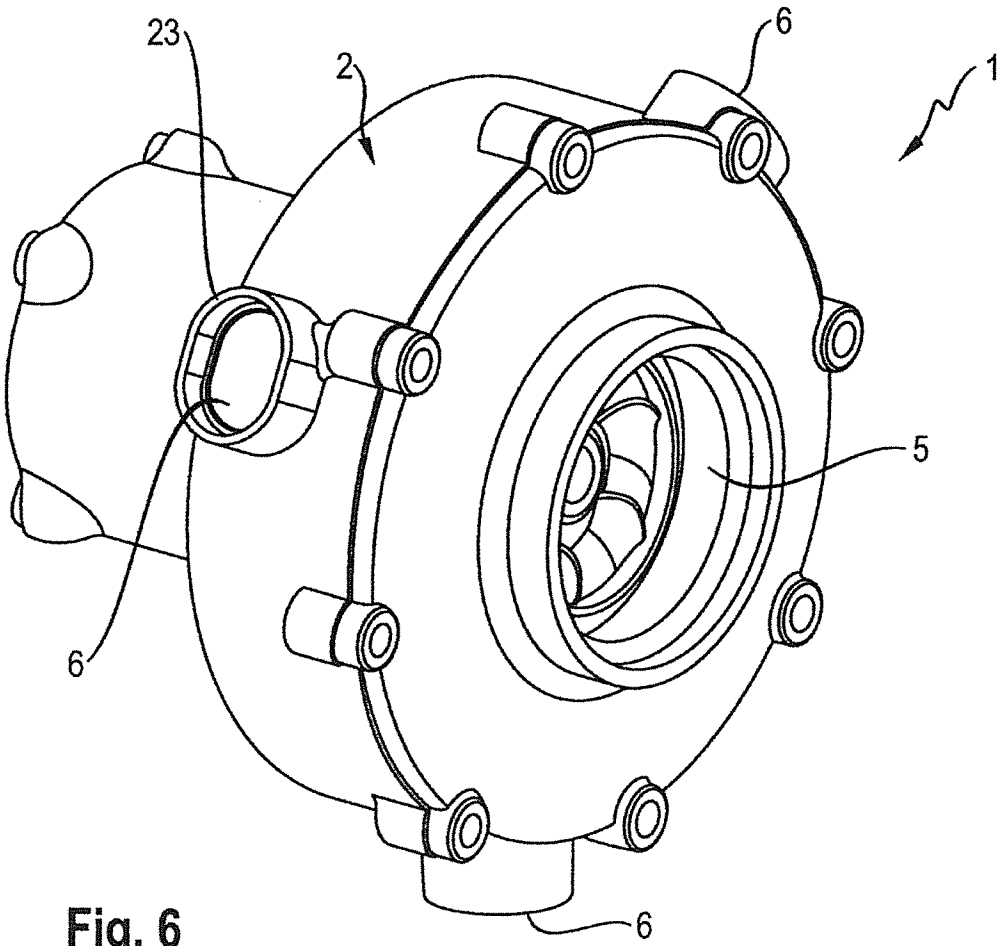
FIG. 6 shows a further side view of an exemplary embodiment of a pump according to the invention.

FIG. 6 shows a view of the pump 1 according to FIG. 1, with the housing 2 having an intake opening 5, and having three outlet openings 6 arranged in a distributed manner on the circumference of the housing 2. The outlet openings are in this case arranged offset from one another at an angle of 120° approximately. They form oval connecting pieces into which the encircling walls 23 of the sealing elements 20 engage.

Figure 7:
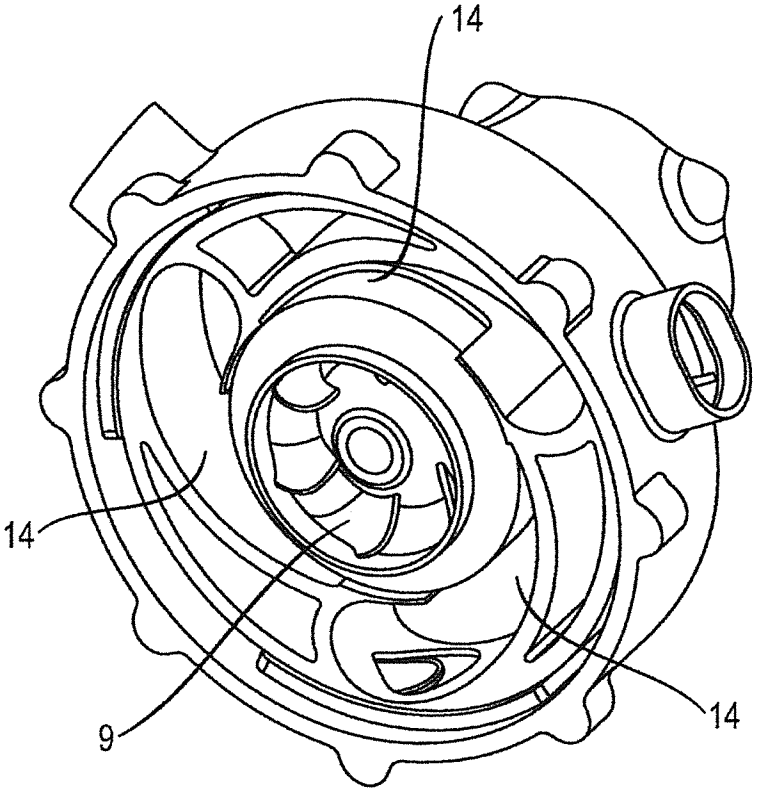
FIG. 7 shows a view of an open exemplary embodiment of a pump according to the invention having an adjustable annular element.

FIG. 7 shows a view of the pump 1 according to FIG. 1 with the housing 2 with removed housing cover 4, so that the annular element 13 can be seen. The adjustable annular element 13 has in this case a plurality of fluid channels 14 that extend from radially inside to radially outside in a spiral-shaped manner and are arranged offset from one another in the circumferential direction. The spiral-shaped fluid channels 14 have radially on the outside in each case an opening 15. The fluid channels 14 are open radially on the inside and are in communication with the pump wheel 9 to be able to receive the fluid flow in the pump wheel 9. The radially inner region of the annular element 13 is situated radially outside the pump wheel 9, and the annular element 13 accommodates the pump wheel 9 in a central recess 16.

Figure 8:
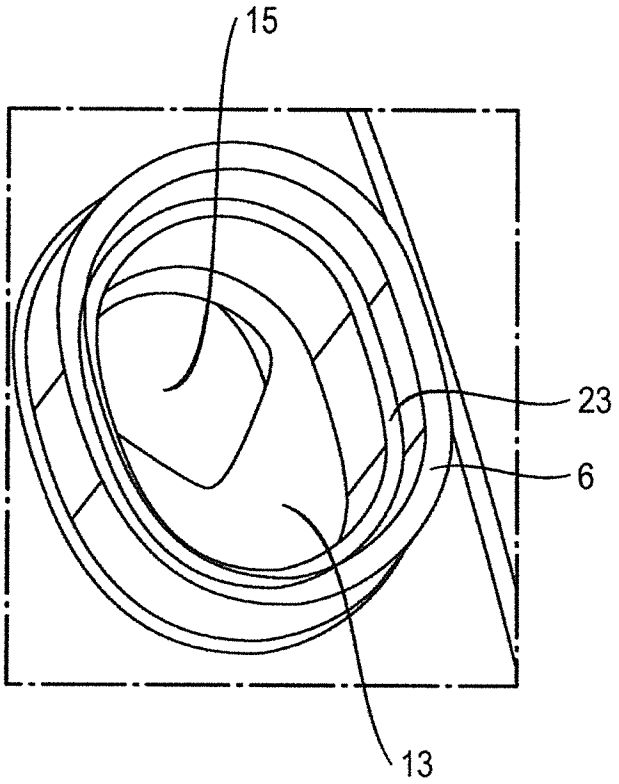
FIG. 8 shows a view of an outlet opening.

FIG. 8 is an illustration of an outlet opening 6 with an encircling wall section 23 of a sealing element 20 and with the annular element 13, with an opening 15 in the annular element. The opening 15 in the annular element 13 is arranged such that the opening approximately only half opens the outlet opening 6. This is due to the setting of the annular element 13 in the housing. By rotating the annular element 13, the outlet opening 6 can be opened to a greater or lesser extent.

FIGS. 9 to 12 show different illustrations of the pump with different settings of the annular element 13 in the pump housing 2 relative to the outlet opening 6.

Figure 9:
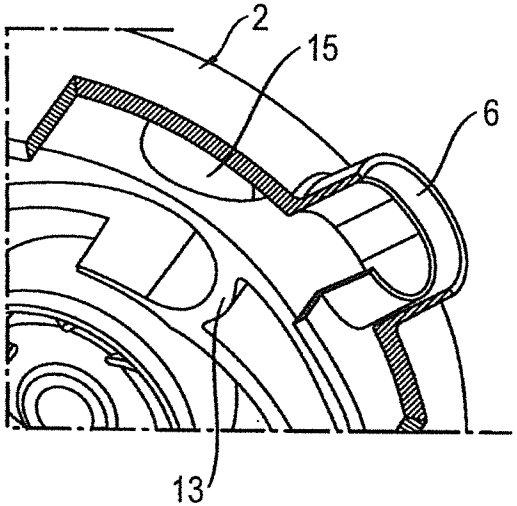
FIG. 9 shows a schematic view of an operating position of the annular element relative to the outlet opening.

In FIG. 9, the outlet opening 6 is closed because the opening 15 in the annular element 13 is displaced relative to the outlet opening 6 to such an extent that the two openings 6, 15 are not aligned, and the radially outer wall of the annular element 13 closes off the outlet opening 6.

Figure 10:
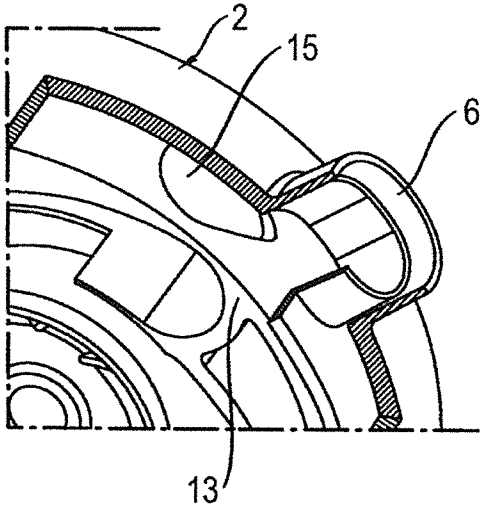
FIG. 10 shows a schematic view of a further operating position of the annular element relative to the outlet opening.

In FIG. 10, the outlet opening 6 is slightly open because the opening 15 in the annular element 13 is set relative to the outlet opening 6 such that the two openings 6, 15 are slightly aligned with one another, and the radially outer wall of the annular element 13 almost completely closes off the outlet opening 6, which means that a small throughflow cross section remains free.

Figure 11:
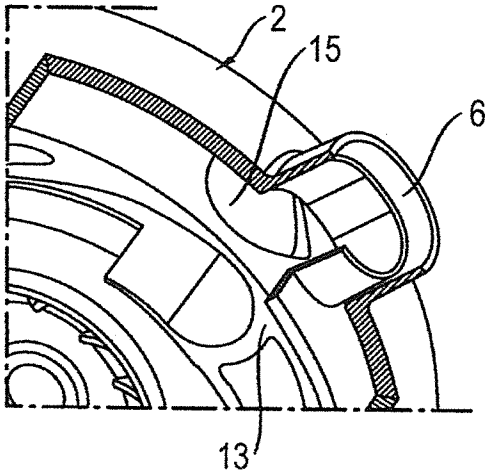
FIG. 11 shows a schematic view of a further operating position of the annular element relative to the outlet opening.

In FIG. 11, the outlet opening 6 is approximately half open because the opening 15 in the annular element 13 is set relative to the outlet opening 6 such that the two openings 6, 15 are approximately semi-aligned with one another, and the radially outer wall of the annular element 13 approximately half closes off the outlet opening 6, which means that approximately half of a throughflow cross section in relation to the maximum throughflow cross section remains free.

Figure 12:
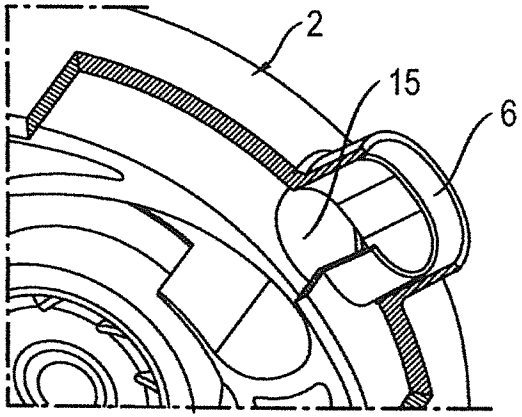
FIG. 12 shows a schematic view of a further operating position of the annular element relative to the outlet opening.

In FIG. 12, the outlet opening 6 is open to a maximum extent because the opening 15 in the annular element 13 is set relative to the outlet opening 6 such that the two openings 6, 15 are aligned completely with one another. Thus, a maximum, half throughflow cross section for the throughflow is available.

The invention claimed is:

1. A pump comprising: a pump housing with an intake opening and outlet openings, a pump wheel accommodated in a rotationally drivable manner in the housing to bring about a fluid flow from the intake opening to at least one of the outlet openings, and an adjustable annular element provided radially outside the pump wheel and inside the housing and having fluid channels that extend from radially inside to radially outside in a spiral-shaped manner and each of the fluid channels being open out into one of plural annular element openings that are arranged radially outside the annular element, the adjustable annular element setting the fluid flow through the respective outlet opening, and at least one outlet sealing element arranged radially between the adjustable annular element and the radially outer circumferential wall of the housing in a region of the respective outlet opening, the at least one outlet sealing element having an arcuately curved wall into which an opening is introduced, and a radially outwardly projecting, encircling wall section projecting from the curved wall at the opening.

2. The pump of claim 1, wherein the housing is substantially cylindrical and has a first end wall a second end wall and a radially outer circumferential wall, the outlet openings being arranged on the radially outer circumferential wall.

3. The pump of claim 2, wherein the outlet openings are arranged on the radially outer circumferential wall so as to be distributed in a circumferential direction and spaced apart from one another.

4. The pump of claim 2, wherein the intake opening is arranged on the first end walls.

5. The pump of claim 4, further comprising a drive shaft that engages through an opening in the second end wall for driving the pump wheel.

6. The pump of claim 1, further comprising a drive means for driving the pump wheel, the drive means being arranged inside the housing.

7. The pump of claim 1, wherein the wall section projects into an outlet opening.

8. The pump of claim 1, wherein the at least one outlet opening is surrounded by a connecting piece that projects from the radially outer circumferential wall of the housing.

9. The pump of claim 1, further comprising an actuator for adjusting the adjustable annular element in a circumferential direction.

10. The pump of claim 9, wherein the actuator is a pneumatic, hydraulic, magnetic and/or electromotive actuator.

11. The pump of claim 1 further comprising an intake sealing element arranged axially between the pump wheel and the adjustable annular element on one side, and an end wall of the housing on an opposite side.

12. The pump of claim 11, wherein the intake sealing element has a substantially annular disk with an opening, and an axially projecting connecting piece projects all around the opening and engages into the intake opening.

* * * * *